US009901221B2

(12) United States Patent
Larsson et al.

(10) Patent No.: US 9,901,221 B2
(45) Date of Patent: Feb. 27, 2018

(54) DISPENSER FOR INTERFOLDED NAPKINS

(71) Applicant: SCA Hygiene Products AB, Göteborg (SE)

(72) Inventors: Björn Larsson, Göteborg (SE); Sofia Hodossy, Göteborg (SE); Martin Stenberg, Torslanda (SE); Viktor Berglin, Stockholm (SE); Mårten Rittfeldt, Skanör (SE); Susanne Carlstedt, Furulund (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 27 days.

(21) Appl. No.: 15/100,751

(22) PCT Filed: Dec. 9, 2013

(86) PCT No.: PCT/SE2013/051472
§ 371 (c)(1),
(2) Date: Jun. 1, 2016

(87) PCT Pub. No.: WO2015/088400
PCT Pub. Date: Jun. 18, 2015

(65) Prior Publication Data

US 2016/0302627 A1 Oct. 20, 2016

(51) Int. Cl.
*A47K 10/24* (2006.01)
*B65H 1/00* (2006.01)
(Continued)

(52) U.S. Cl.
CPC ..... *A47K 10/423* (2013.01); *B65D 83/0805* (2013.01); *B65D 83/0894* (2013.01); *A47K 2010/3233* (2013.01)

(58) Field of Classification Search
CPC ..... A47K 10/42; A47K 10/20; A47K 10/423; A47K 2010/3233; B65D 83/0805; B65D 83/0894
(Continued)

(56) References Cited

U.S. PATENT DOCUMENTS 1,583,293 A * 5/1926 Horwitt ..... A47K 10/421 211/51
1,707,578 A * 4/1929 Shaffer ..... A47K 10/422 211/51
(Continued)

FOREIGN PATENT DOCUMENTS

CN 2785524 Y 6/2006
CN 102458204 A 5/2012
(Continued)

OTHER PUBLICATIONS

Extended European Search Report dated Jun. 21, 2017 in European Patent Application No. 13899230.0.
(Continued)

*Primary Examiner* — Rakesh Kumar
(74) *Attorney, Agent, or Firm* — Drinker Biddle & Reath LLP

(57) ABSTRACT

A dispenser for interfolded napkins, having an upper portion and a lower portion, a longitudinal direction and a transverse direction is disclosed. The dispenser includes a container having a bottom wall extending in a horizontal plane and being arranged at the lower portion of the dispenser, and side walls having upper edges and lower edges and extending from the bottom wall in a vertical direction perpendicular thereto; a dispensing opening arranged at the upper portion of the dispenser opposite to the bottom wall; a weight arranged between the side walls so as to form a stack-supported lid of the dispenser that is movable between an upper position adjacent to the dispensing opening, and a
(Continued)

lower position adjacent to the bottom wall; and a weight control means interconnecting the weight and the container, and extending inside the container between a container connection arranged at the lower portion of the dispenser and a weight connection arranged at the upper portion of the dispenser. The weight control means restricts the movement of the weight in a vertical direction along the side walls so as to determine the location of the upper position of the weight.

25 Claims, 9 Drawing Sheets

(51) Int. Cl.
*A47K 10/42* (2006.01)
*B65D 83/08* (2006.01)
*A47K 10/32* (2006.01)

(58) Field of Classification Search
USPC ..... 221/48
See application file for complete search history.

(56) References Cited

U.S. PATENT DOCUMENTS 2,872,067 A * 2/1959 Gessner ..... A24F 19/025 131/241
3,343,716 A * 9/1967 Meade Peebles David ..... B65D 83/0817 221/197
3,647,114 A * 3/1972 Bleuer ..... A47K 10/422 221/279
4,796,781 A * 1/1989 Windorski ..... B42D 5/005 221/45
4,896,773 A * 1/1990 Zilio ..... A47K 10/185 206/440
4,921,127 A * 5/1990 Windorski ..... B42D 5/005 221/45
4,953,747 A 9/1990 Wenkman et al.
4,986,440 A * 1/1991 Windorski ..... B42D 5/005 221/45
5,067,628 A * 11/1991 Evenson ..... B42D 5/005 221/52
5,080,255 A * 1/1992 Windorski ..... B42D 5/005 221/45
5,540,354 A 7/1996 Annand
5,622,281 A 4/1997 Annand
6,000,538 A * 12/1999 Lee ..... A47K 10/421 206/233
7,273,156 B2 * 9/2007 Gao ..... B65D 83/0805 221/47
7,665,628 B1 * 2/2010 Milligan ..... A47K 10/422 221/213
8,631,968 B2 * 1/2014 Taylor ..... A47K 10/422 221/36
9,230,388 B2 * 1/2016 Julius ..... G07F 9/10
2005/0269343 A1 * 12/2005 Gao ..... B65D 83/0805 221/63
2006/0102641 A1 * 5/2006 Cittadino ..... A47K 10/422 221/45
2011/0297694 A1 12/2011 Conway et al.
2012/0067918 A1 * 3/2012 Nordlund ..... A47K 10/423 221/199
2012/0279984 A1 * 11/2012 Brolin ..... A47K 10/426 221/197
2014/0076917 A1 * 3/2014 Siebel ..... A47K 10/427 221/35
2014/0284241 A1 * 9/2014 Pearson ..... A47K 10/20 206/494
2014/0319164 A1 * 10/2014 Wilson ..... A47K 10/422 221/45
2014/0326745 A1 * 11/2014 Young ..... A47K 10/422 221/45
2015/0021351 A1 * 1/2015 Kaneko ..... A61B 5/1118 221/45
2015/0048104 A1 * 2/2015 Wilson ..... A47K 10/422 221/45
2015/0250364 A1 * 9/2015 Yamada ..... A47K 10/427 221/46
2016/0088982 A1 * 3/2016 Larsson ..... A47K 10/422 221/2

FOREIGN PATENT DOCUMENTS

JP H08-175577 7/1996
JP 2008162660 * 12/2006
JP 2008-162660 A 7/2008
JP 2011168310 * 2/2010
RU 2011151047 A1 6/2013
WO WO-2010/132005 A1 11/2010
WO WO2014019037 * 8/2012

OTHER PUBLICATIONS

Decision on Grant (along with its English-language translation) dated Oct. 16, 2017 in Russian Patent Application No. 2016127543.
Decision on Grant dated Nov. 20, 2017 in Russian Patent Application No. 2016127545.

* cited by examiner

DISPENSER FOR INTERFOLDED NAPKINS

CROSS-REFERENCE TO PRIOR APPLICATION

This application is a § 371 National Stage Application of PCT International Application No. PCT/SE2013/051472 filed Dec. 9, 2013, which is incorporated herein in its entirety.

TECHNICAL FIELD

The present disclosure relates to a dispenser for interfolded napkins, the dispenser including a container having a bottom wall extending in a horizontal plane, and side walls extending from the bottom wall in a vertical direction perpendicular thereto and defining a dispensing opening opposite to the bottom wall, the side walls surrounding a rectangular supporting surface for supporting a stack of interfolded napkins. The dispenser further includes a weight arranged between the side walls so as to form a stack-supported lid of the dispenser, the weight defining a dispensing mouth and being movable between an upper position adjacent to the dispensing opening of the container, and a lower position adjacent to the supporting surface of the container.

BACKGROUND

Napkins in the form of sheets of material intended for wiping and for hygienic purposes are common household items that may be provided in the form of stacks of napkins from which individual napkins can be readily extracted when needed. It is desired for the dispenser for the napkins to be relatively inexpensive, easy to handle, able to protect the napkins prior to use, and easy to move to a location where the napkins are needed, such as to a table, a counter, etc.

A common type of dispenser for this kind of napkins is an open cardboard box in which the napkins are arranged in a stack standing on an edge of the napkins with a part of the napkins protruding through the opening in the box to provide a gripping portion. This is a simple and inexpensive way of dispensing the napkins. However, the protruding parts of the napkins tend to fold over the edge of the box and become ruffled and deformed.

Moreover, as soon as a few napkins have been removed from the box, the remaining stack does not fill the width of the container with the result that the stack may buckle inside the box contributing to the deformation of the not yet dispensed napkins, and rendering the gripping of the napkins more difficult.

A further commonly used option is to arrange the napkins in an interfolded stack which is placed standing on a bottom surface inside a container having a dispensing opening at the top of the container. The napkins are then successively removed from the top of the stack through the dispensing opening.

Interfolded napkins are sheets of materials arranged in a stack of superposed sheets which are each folded at least once. The sheets are interlinked in such a way that the separate folded sheets of material form a chain of sheets where each sheet has a leading panel and a trailing panel, the trailing panel being at least partly overlapped with the leading panel of the subsequent sheet in the stack. In this manner, the individual sheets are held loosely together by means of frictional forces arising between the overlapping parts. Except for the first and the last napkin in the stack, each trailing panel of each napkin is connected by interfolding to the leading panel of the next napkin in the stack. The sheets may be dispensed from a dispenser by pulling at the leading panel of the first sheet in the stack. In this manner, the first material sheet is extracted at the same time as a predetermined part of the leading panel of a subsequent material sheet is fed into a dispensing position in the dispenser.

The dispenser usually has a lid or cover with a dispensing opening that restricts the width of the dispensed napkin in order to keep the leading panel of the next napkin to be dispensed from falling back into the dispenser.

JP2008162660 describes a tissue-paper holder including a container for holding a stack of napkins, the container defining an upwardly directed dispensing opening, in which a movable lid is placed, the lid forming a weight being supported by the stack. The lid defines a dispensing mouth.

WO2010/132005 describes a dispenser arrangement for interfolding napkins, where the dispenser includes a container for holding a stack of napkins, the container defining a dispensing opening. At least one weight having a projected surface on the bottom wall which is less than or equal to one third of the stack-supporting surface, is placed in the container, and is intended to be supported by the stack.

It is desired to provide an improved or alternative dispenser for dispensing interfolded napkins to those dispensers discussed above.

SUMMARY

The term "dispensing opening" herein means a portion of a container being open towards the ambient and being used for providing access to the inner space of the container.

The term "dispensing mouth" herein means an opening through which items are dispensed.

As used herein, the expression "in contact with" means that two surfaces are positioned at a distance from each other being as small as possible while being sufficient to enable movement of the surfaces along each other.

Herein, by the term "adjacent" is meant items being nearest in space or position, immediately adjoining without intervening space, touching; and also items being near or close but not necessarily touching.

Herein, by the term "magnetic lock" is meant a device for holding pieces of material together by magnetism.

The term "magnet" in the context of the present application means a permanent magnet.

The term "corresponding magnetic material" in the context of the present application means a material being attracted to a particular magnet. This material may be another permanent magnet, or it may be a material attracted to the particular magnet such as a soft or hard ferromagnetic material.

In a first aspect, there is provided a dispenser for interfolded napkins. The dispenser includes a container having a bottom wall extending in a horizontal plane and being arranged at the lower portion of the dispenser. The container further includes side walls extending from the bottom wall in a vertical direction perpendicular to the horizontal plane of the bottom wall and defining a dispensing opening opposite to the bottom wall. The side walls surround a rectangular supporting surface for supporting a stack of interfolded napkins.

The dispenser further includes a weight arranged between the side walls so as to form a stack-supported lid of the dispenser. The weight defines a dispensing mouth through which napkins are withdrawn. The weight is movable between an upper position adjacent to the dispensing opening of the container, and a lower position adjacent to the supporting surface of the container. The dispenser further includes a weight control means interconnecting the weight and the container and extending inside the container between a container connection and a weight connection. The weight control means restricts the movement of the weight in a vertical direction along the side walls so as to determine the location of the upper position of the weight.

In particular embodiments, apart from the restriction provided by said weight control means, the weight is free to move vertically inside the container.

Hence, in use, the weight resting on the stack of napkins will follow the stack downwards, as the stack diminishes, and thereafter it will be upwardly movable for refilling of the dispenser.

Accordingly, the use of a weight is efficient to hinder the stack from becoming crumpled inside the dispenser.

The weight control means will secure the weight to the dispenser. Thereby, the risk that the weight is displaced during handling of the dispenser, or becoming lost or even stolen, is reduced.

The weight control means determines the location of the upper position of the weight. Accordingly, the space available inside the dispenser for containing the stack is determined, which contributes to diminishing the risk for overfilling the dispenser with too many napkins. If a dispenser is overfilled with napkins, there is a risk that an unduly high frictional force will result between subsequent napkins.

Advantageously, the weight control means provides said restriction of the movement in a vertical direction so as to determine the upper position of the weight on its own, that is without any additional movement restriction means. Accordingly, the (one or more) weight control means interconnecting the container and the weight is the only means determining the location of the upper position of the weight.

In particular embodiments, the weight control means extends freely between said container connection and said weight connection.

Advantageously, the outer contour of the weight is adapted to the inner contour of the side walls of the container, such that a rim of the weight at least partly follows the inner contour formed by the side walls. Accordingly, the side walls will guide the weight during its movement between its upper and lower position.

The bottom wall of the container may have any suitable circumferential shape such as circular, rectangular with right angles or rounded corners, square, triangular, rhombic or irregular, as long as the bottom wall provides a sufficiently large supporting surface for a stack of interfolded napkins. In particular embodiments, the bottom wall of the container has a generally rectangular shape, corresponding to the shape of the supporting surface. The supporting surface should have a generally rectangular shape, corresponding to the shape of the stack of napkins to be introduced into the container. The term "rectangular" is to include all four-sided plane figures with four substantially right angles.

The bottom wall of the container may form the outermost bottom surface of the container. This provides a simple and space-saving solution.

However, the dispenser could be provided with an additional outer bottom surface, arranged at a distance from the bottom wall of the container in the vertical direction, if so desired e.g. reasons of design or for fastening of the dispenser to an underlying surface.

The side walls of the container can extend perpendicular to the plane of the bottom wall of the container, and perpendicular to the supporting surface.

The side walls delimit the container space and the size of the dispensing opening and are arranged to contain and support the stack of interfolded napkins without deforming the napkins. The side walls will hence also provide side support for the stack of napkins, and the weight, when the container is in use.

The support surface is to be rectangular, meaning that the support surface shall enable support of a rectangular stack of napkins. To this end, it is desired to have a generally rectangular shape, although slight deviations from the general shape such as rounded corners etc. are conceivable. In particular embodiments, the support surface forms a generally complete surface, i.e. a wall. However, it is also conceivable to form the support surface using e.g. ribs or ledges for supporting the stack of napkins.

For the stack to be supported in horizontal directions, the side walls should extend vertically so as to surround and support the stack around the rectangular periphery thereof. To this end, the side walls should have a certain extension along the periphery of the rectangular support surface. However, it will be understood that the side walls need not form a closed wall surface, but could be provided with openings or slots, if desired. Alternatively, the side walls could be formed by a number of ribs arranged vertically and at a distance from each other. In a particular alternative, the side walls form closed side walls extending along at least 50% of the rectangular circumference of the supporting surface.

In particular embodiments, the side walls may form the outermost wall structure of the dispenser. This provides a simple and space-saving solution. However, the dispenser could be provided with additional outer walls, surrounding the side walls of the container. This could be desired, if e.g. a dispenser having a rounded outer design is desired.

As mentioned above, the side walls define the dispensing opening arranged at the upper portion of the dispenser. The dispensing opening can be a part of the container being open towards the ambient and providing access to the inner space of the container. The outline of the dispensing opening will generally correspond to the shape of the supporting surface.

In particular embodiments, the outline of the dispensing opening essentially corresponds to the outline of the supporting surface, in terms of the outer dimensions of the dispensing opening and the supporting surface. Hence, should the weight be removed from the dispenser, the entire top surface of a stack of napkins resting on the supporting surface in the container will be readily accessible via the dispensing opening.

The side walls can form upper edges at an upper portion of the dispenser towards the dispensing opening. The shape of the upper edges of the container may vary, for example the upper edges may be straight, or of irregular shape, such as undulating, serrated, semicircular, or the like.

In particular embodiments, the upper edges form a plurality of uppermost edge portions, which may be confined in a horizontal plane being parallel to the plane of the bottom wall. As such, if the dispenser is turned upside-down, it may rest in a stable position on the plurality of uppermost edge portions confined in said horizontal plane. Advantageously, to provide stable position, uppermost edge portions on at least two opposing side walls of the container should be confined in a horizontal plane.

In particular embodiments, the uppermost edge portions may form continuous upper edges extending along at least two opposing side walls of the container, and being confined in a plane, (the entire upper edges will then form said uppermost edge portions), such as a generally horizontal plane, whereby a particularly stable upside-down position of the dispenser is enabled.

The weight can form a stack-supported lid of the dispenser, meaning that when a stack of napkins is inserted into the dispenser, the weight will rest on the stack. Accordingly, when the dispenser is completely filled with napkins, the weight can be located in its upper position adjacent to the dispensing opening of the container, while when the dispenser is nearly empty or empty, the weight will be located adjacent to the supporting surface of the container. The weight can be vertically movable inside the container between the upper position adjacent to the dispensing opening of the container, and the lower position adjacent to the supporting surface of the container, in both the upward and the downward directions.

The actual mass of the weight should be sufficient to withstand the pull force from the user withdrawing a napkin from a dispenser, and can be selected to be suitable for a particular dispenser and/or stack of napkins.

The mass of the weight may thus be between 50 and 1000 g, between 50 and 500 g, or between 100 and 200 g.

To provide a weight having a suitable mass, the weight may include a first and a second material, wherein the second material has a greater density than the first material, so as to provide additional mass to the weight. For example, a first material forming the majority of the weight might be a plastic material, having the advantages of being easy to form to desired shapes, but not being particularly heavy. To increase the mass of the weight, a second material in the form of a metal, such as lead, iron, copper or nickel, or an alloy, such as stainless steel, cast iron, or any other alloys with high density may be added to the first material.

For example, the weight may be formed by two halves of a first material, which are joined together to form the complete weight. Pieces of a second, heavier, material may be added in between the two halves, before joining thereof to a complete weight.

Another option is to form the weight by casting the first material in a mould containing pieces of the second material arranged inside the mould such that the second material becomes embedded in the first material.

In accordance with what is proposed herein, the weight defines an outer rim including at least two opposing rim portions. Further, the weight extends over the entire dispensing opening in at least one horizontal direction between at least two opposing side walls of the container, such that the two opposing rim portions are in contact with the two opposing side walls of the container.

For ensuring that the weight remains in a desired position within the container, i.e. so that the dispensing mouth is properly located therein, it is advantageous if the outer rim comprises includes two opposing rim portions, which are in contact with corresponding portions of two opposing of the side walls of the container. Accordingly, a certain control of the location and movement of the weight in the container is ensured.

Advantageously, the weight may extend over the entire dispensing opening such that the entire inner perimeter of the side walls is in contact with the weight.

It is possible that the weight includes some protruding portions which would extend beyond the inner perimeter of the side walls, e.g. through a vertical slot provided in the side wall. However, in particular embodiments, the weight is confined between the side walls, such that no moving portions of the weight extend outwards of the side walls, thus eliminating the risk of objects positioned adjacent to the dispenser becoming unintentionally caught by the weight when the dispenser is in use. Moreover, the external appearance of the dispenser may be rendered more aesthetically pleasing if no protruding portions are present.

The total horizontal area of the weight including the dispensing mouth may be at least 60% or at least 80% of the area of the supporting surface. Advantageously, the total horizontal area of the weight essentially corresponds to the area of the supporting surface.

The weight will naturally have a vertical extension or vertical height. The vertical height discussed herein is the maximum vertical height of the weight as seen over the entire horizontal surface of the weight. Advantageously, the vertical height of the weight may be adapted so as to contribute to the proper dispensing and presentation of a leading end of the uppermost napkin in a stack arranged in the dispenser. For example, it will be appreciated that a leading end of a certain vertical extension may be able to assume an upright position when extending from the dispensing mouth of the dispenser, whereas if a longer leading end of the napkin extends from the dispensing mouth, the leading end might assume an unwanted drooping position.

The vertical height of the weight will determine the length of the portion of a napkin extending from the topmost surface of the stack to the dispensing mouth, and will accordingly influence the length of the leading end protruding from the dispensing mouth to be presented to a user.

For some useful applications, the vertical height of the weight may be 1-10 cm, 1-5 cm, or 2-5 cm.

The weight may be formed having a uniform vertical height all over its horizontal surface. However, it may also be formed with a generally flat lower surface, i.e. the surface facing the inside of the container when the weight is arranged between the side walls of the container, wherein the lower surface of the weight also includes protrusions. The protrusions may be continuous, i.e. running along the entire lower surface of the weight, or intermittent, being arranged at spaced-apart positions across the lower surface of the weight. The intermittent protrusions may be in the form of cylinders, cones, cubes, pyramids or the like. In particular embodiments, the protrusions are continuous protrusions in the form of longitudinally extending ribs. The vertical extension of the protrusions will hence determine the vertical height of the weight.

The protrusions may be arranged at a distance from the dispensing mouth. Accordingly, the protrusions will ensure that there will be a space between the lower surface of the weight immediately surrounding the dispensing mouth, and the top of the stack of napkins introduced in the dispenser. Such a space will ensure that the stack is not clamped against the dispensing mouth, which would complicate the removal of napkins from the stack.

The weight includes a dispensing mouth, i.e. an opening through which items are dispensed. The dispensing mouth will be positioned over the items inside the container, so as to be aligned with a leading end of the stack of napkins, when the weight is positioned over the dispensing opening of the container.

The weight including the dispensing mouth will simultaneously present a leading end of the uppermost napkin in the stack through the dispensing mouth, and hold down the remaining part of the stack, such that additional, unwanted napkins are not removed from the stack together with the uppermost napkin. Instead, due to the interfolding of the napkins, removal of the uppermost napkin will result in the leading end of the next napkin being presented in the dispensing mouth.

By means of the weight forming a dispensing mouth, fall-back of the gripping portion of the uppermost napkin in a stack of interfolded napkins is avoided without the risk of the tearing or wrinkling of the napkin being pulled out or of the subsequent napkin. The dispenser arrangement can also ascertain that only one napkin is dispensed at a time. The dispenser can easily be operated with only one hand and has a simple and reliable construction.

If the weight extends over the dispensing opening substantially all the way between at least two opposing side walls of the container, the dispensing mouth may then be arranged such that it extends in a longitudinal direction of the dispenser between the opposing rim portions.

The dispensing mouth can be elongate and have a maximum length dimension extending in parallel with two opposing side walls.

In use, the leading end of the uppermost napkin in the stack positioned in the dispenser extends between two opposing side walls. Accordingly, the dispensing mouth will extend longitudinally along the width of the leading end, such that the napkins may be extracted through the dispensing mouth with little or no wrinkling. In particular embodiments, the extension of the dispensing mouth is at least the same as the width of the stack of napkins introduced in the dispenser.

Hence, the full width of a leading end of the uppermost napkin may be presented to a user in a smooth, unwrinkled state. Moreover, the entire napkin will, when dispensed, have a smooth, aesthetically pleasing appearance. Moreover, the risk that the napkins should become ripped or otherwise damaged upon dispensing, is considerably reduced.

Expressed in relation to the longitudinal extension of the supporting surface of the container, the dispensing mouth may have a longitudinal extension of at least 75%, at least 85%, or at least 90% of the longitudinal extension of the supporting surface extending between the side walls. Also, the longitudinal extension of the dispensing mouth may be 100% of the longitudinal extension of the supporting surface, i.e. the longitudinal extension of the dispensing mouth is equal to the longitudinal extension of the supporting surface.

The dispensing mouth will also have a transverse extension, or a width, in a transverse direction perpendicular to the direction of maximal length extension of the mouth. The width of the dispensing mouth should be sufficient for a napkin to easily pass there through. Moreover, the dispensing mouth may be provided with at least one portion having a greater width than the other portions of the dispensing mouth. For example, such a portion could be arranged at the centre of the dispensing mouth. The portion with a greater width could be designed so as to facilitate gripping of the napkin. Also, a sufficiently great width may be provided to enable gripping of a first leading end of the uppermost napkin in a stack introduced in the dispenser, when the leading end is laying flatly down on the uppermost surface of the stack.

Further, it may still be desired to maintain portions of the dispensing mouth with a relatively narrow width, e.g. the portions of the dispensing mouth positioned adjacent to the side walls when the weight is arranged inside the container, since such portions may support a leading end protruding through the dispensing mouth, such that the leading end is presented in an upright position for a user to grasp. Such a narrow width suitable for supporting a leading end in an upright position might for example be about 10-15 mm.

The dispensing mouth may have any suitable shape, such as oval or rectangular, provided that the dispensing mouth does not crease or in other way damage the napkin to be dispensed, and that the dispensing mouth provides sufficient support for the leading end of the napkin, such that the leading end of the napkin is in its upright position prior to use.

To further control the movement and/or location of the weight inside the container, a weight control means is provided interconnecting the weight and the container, thereby extending between a container connection and a weight connection.

The weight control means can define an upper position of the weight inside the container. This upper position can determine the maximum size of a stack to be introduced into the dispenser.

The weight control means should allow movement of the weight between the upper position and the lower position, as described in the above.

To this end, the weight control means may for example be attached via a container connection at a side wall, located at mid-height between the upper position and the lower position, and with a length of the weight control means being sufficient for the weight to reach the upper position and the lower position.

Alternatively, the weight control means may be attached via a container connection at a side wall, located anywhere between mid-height and the lower position of the weight. In this case, the length of the weight control means will be selected so as to determine the upper position of the weight. Since the distance from the container connection to the upper position of the weight will, according to this alternative, always surpass the distance from the container connection to the lower position, the weight control means will not restrict the movement towards the lower position. Instead, the lower position of the weight is assumed merely when the weight reaches the support surface.

Advantageously, the weight control means may be attached via a container connection at a side wall, and adjacent the supporting surface. In this case, the container connection will be located adjacent to or approximately at the same vertical height as the lower position of the weight. The length of the weight control means will be approximately the distance between the upper position and the lower position of the weight. Accordingly, the length of the weight control means will approximately correspond to the height of a stack to be introduced into the dispenser.

The container connection may advantageously be situated at one of the side walls of the container. Alternatively, the container connection could be situated at the supporting surface, next to a side wall of the container. The weight connection may advantageously be situated adjacent the rim of the weight. In a particular embodiment, the weight connection is located at a rim portion generally corresponding to the location of the side wall at which the container connection is situated.

Moreover, the weight connection and the rim connection can be located at wall portions and corresponding rim portions which are arranged to be in contact with each other.

Accordingly, the weight control means will be located inside the dispenser, connecting the weight to the container. Hence, the weight control means will ensure that the weight cannot be completely removed from the container.

Moreover, the weight control means will contribute to the control of the lateral movement of the weight inside the dispenser between the upper position and the lower position. Depending on the location and configuration of the weight control means, lateral control of the weight may be enabled.

In particular embodiments, the dispenser includes two weight control means interconnecting the weight and the container. The weight control means are then arranged one at each opposing side wall and corresponding rim portion.

With two weight control means on opposing sides of the dispenser, additional lateral control of the weight may be enabled. Moreover, with two weight control means, the upper position of the weight inside the dispenser will be more clearly defined, as well as the maximum size of a stack to be introduced in the dispenser. The weight control means may be arranged at any position along the inner perimeter of the dispenser, i.e. along any of the side walls running in either longitudinal or transverse direction. When the dispenser includes two weight control means, it is advantageous to arrange the weight control means in an opposing manner in order to achieve an optimal distribution of the pull force from a user extracting an item from the dispenser.

It will be understood that the dispenser can include at least two weight control means, and could be provided with e.g. three or four weight control means. For example, one weight control means could be arranged at each corner of the weight.

It is of importance that the weight control means is flexible enough to allow the movement of the weight control means in the vertical direction between the upper and the lower positions. In particular embodiments, the weight control means includes a flexible cord, for example in the form of a ribbon or a chain. A suitable ribbon may be of a textile material, e.g. a polyester material.

The length of the weight control means between the container connection and the weight connection may essentially correspond to the vertical distance from the container connection to the dispensing opening. Since, as mentioned previously, the dispensing opening is defined by the upper edges of the side walls, the length of the weight control means between the container connection and the weight connection may essentially correspond to the maximum vertical distance from the container connection to upper edge of the side walls. In cases when the upper edge of the side walls has irregular shape, the length of the weight control means between the container connection and the weight connection may essentially correspond to the vertical distance from the container connection to the highest point of the upper edge of the side walls. Accordingly, essentially the full vertical length of the container from the supporting surface to the dispensing opening will be available for a stack of napkins.

The container connection and the weight connection may be of any suitable type of connection as known in the art for fastening pieces together.

In certain embodiments, the container connection may be a snap-in connection. In this case, a first snap connection portion may be provided in the container, and a second snap connection portion on an end portion of the weight control means.

The weight connection may be arranged at or adjacent to the rim of the weight. For example, if the weight is formed by two halves being joined together, an end portion of a weight control means may be introduced between the halves and joined to the weight upon joining of the two halves.

Accordingly, the weight control means can run along the side of a stack of napkins disposed in the dispenser.

The container may include a frame arranged along the side walls surrounding the supporting surface, wherein the frame may include the container connection. The frame may be positioned adjacent to the bottom wall at the lower edge of the side walls. For example, the frame may be press-fit inside the container at the lower edge of the side walls. In particular embodiments, a cut-out may be made along the inner perimeter of the side walls, for receiving the frame. The frame may be made of a plastic material, or any other material suitable for the purpose.

The container may define at least one vertical slot in at least one of the side walls. The horizontal extension of the slot may be sufficient to allow manual access to the napkins in the container via the slot. Hence, the slot may be useful for grasping the first leading end of a new stack of napkins, which is to be introduced to the dispensing mouth for the initial set-up of the dispenser.

Moreover, such a slot may, in certain embodiments, be useful when refilling the dispenser, as will be described in the below. Additionally, a slot may be useful for providing a visual indication of the need for refilling.

A dispenser as proposed herein may, if only one weight control means is used, be refilled via the dispensing opening of the container by removing the weight from the dispensing opening, tilting the weight, still being attached to the container at the end of the weight control means, thus providing access to the inner space of the container through the dispensing opening, and positioning the stack of napkins inside the container.

However, another option is to provide a refill opening elsewhere in the container.

Advantageously, the container may define a bottom portion including at least the bottom wall, and a wall portion including at least a part of the side walls including the lower edge of the side walls. The bottom portion may be removably attached to the wall portion.

Accordingly, the bottom portion may be removed from the wall portion for refill of napkins from the bottom side of the dispenser.

Hence, refill is possible even though the weight remains in the dispensing opening of the container, attached via the weight control means to the container.

In particular embodiments, the bottom portion consists only of the bottom wall and not the side walls. In this case, the container connection of the weight control means may be arranged at the lower edge of the side walls.

The bottom portion may be removably attached to the wall portion using several types of locking means, such as snap-in connections, locks or the like. A frame as described above may advantageously be used to provide a connection between the bottom portion and the wall portion of the dispenser.

In a particular embodiment, the bottom portion is removably attached to the wall portion by means of a magnetic lock.

A magnetic lock will provide a certain holding force, depending on the type, size and number of magnets and corresponding magnetic materials used. Accordingly, the magnetic lock may be adjusted such that it has a holding force being sufficient to ensure that the bottom portion and the wall portion are held together during use of the dispenser, i.e. that the attraction force may resist the action of gravity on the stack of napkins on the supporting surface. Moreover, the magnetic lock may be adjusted such that it will preclude forcing too many napkins into the dispenser. In other words, if too large a stack is positioned inside the container, and an attempt is made to close the bottom portion thus compressing the napkins, the magnetic lock will not close since the spring force from the stack attempting to resume its original shape will exceed the attraction force of the magnetic lock. Accordingly, a magnetic lock may be selected such that it opens when the spring force exceeds a threshold value of the attraction force of the magnetic lock.

Hence, a magnetic lock may be used to form an efficient overfill protection means, in that it is not possible to force the lock to close, and to keep the lock in function, if there are too many napkins in the form of a compressed stack present in the container.

Disadvantages (such as an increased pull force necessary to withdraw a napkin from the dispenser which may result in the napkins becoming damaged) appearing due to a compressed stack being present in the container may be avoided.

To form a magnetic lock, the magnets and corresponding magnetic materials should be arranged in the wall portion/and or the bottom portion, respectively, in an opposed relationship. The interfacing surfaces formed by the magnets and the corresponding magnetic materials, may generally correspond to each other in size and shape. As used herein, by "interfacing surfaces" are meant surfaces facing towards each other, and which are attracted to each other by magnetism. The magnets and corresponding magnetic materials may be arranged such that their interfacing surfaces are in direct contact with each other, when the magnetic lock is closed. However, the magnets and corresponding magnetic materials may also be arranged such that their interfacing surfaces are separated e.g. by a piece of other material, as long as the attraction between the interfacing surfaces is still sufficient to close the magnetic lock. This may be the case when the magnets and/or corresponding magnetic materials are embedded in the wall portion and/or the bottom portion.

A frame as described above may advantageously be used to provide magnets and/or corresponding magnetic materials to the wall portion of the container. Alternatively, or in addition thereto, the frame may be useful to provide a connector between the wall portion with the bottom portion.

The purpose of the connector is primarily to ensure that the wall portion and the bottom portion stay connected when the bottom portion is opened from the wall portion. The force from the magnetic lock will generally be sufficient to provide necessary guidance of the wall portion and the bottom portion when they are moved towards each other for being locked together. Hence, it is possible, but not necessary to provide a connector performing also substantial guidance of the movement between the wall portion and the bottom portion, such as a rigid hinge-like connector.

The connector may be a so-called soft-hinge connector, being formed by a soft material such as a plastic or textile material, for example TPE, silicone, polyester, or cotton textile. Such connectors has the advantage that they may be formed to take up very limited space only.

Magnets and/or corresponding magnetic materials may be provided in the bottom portion e.g. by gluing, casting or the like.

The bottom portion may be provided with a gripping means for facilitating removal of the bottom portion from the wall portion. Advantageously, the gripping means may be in the form of a notch in the bottom portion.

As mentioned above, the uppermost edge portions of the side walls may be confined in a plane, such as a generally horizontal plane, whereby a stable upside-down position of the dispenser is enabled. Accordingly, the dispenser may conveniently be positioned resting on the uppermost edges of the side walls in an upside down position for refill of the dispenser from the bottom side thereof.

When turning a dispenser upside down for refill thereof, the user may hold any remaining napkins in the dispenser via the vertical slot as described above in order to ensure that the remaining napkins do not become folded or otherwise rearranged in the dispenser during the turning thereof. Advantageously, also the weight is held towards the supporting surface, pressing any remaining napkins in the dispenser towards the supporting surface, using said vertical slot. Once the dispenser has assumed an upside-down position, the weight and any remaining napkins may be released. The weight will fall down and assume an upside-down position on the underlying structure, such as a table surface, and any remaining napkins and will come to rest towards the lower surface of the weight.

It is also conceivable to perform the turning of the dispenser upside down without necessity of holding back the napkins.

When the dispenser is being used, a stack of interfolded napkins is placed on the supporting surface of the bottom wall. The stack of interfolded napkins may have a rectangular shape with rectangular or square bottom surface corresponding to the trailing panel of the last napkin in the stack. The stack may have any suitable dimensions such as any suitable height, width and length. The width and length dimensions are defined by the dimensions of the bottom surface of the stack and the height is measured perpendicular to the bottom surface and is determined by the number of napkins in the stack as well as the number of plies and panels in each napkin. The individual napkins may include one or more plies or layers and may have been folded into two or more panels.

The napkins may be any kind of household napkins, wipes, paper towels, etc. The material may be a fibrous material of any suitable kind such as cellulose based paper materials, with or without admixture of man-made fibres, binders and fillers. The napkins may include only man-made fibres. However, it is usually desired that a napkin has some degree of absorbency or that it at least is wettable. If the fibrous material contains a large proportion of fibres of a hydrophobic character implying that the fibres are non-wettable, it may be suitable to treat the material with a wetting agent. Wetting agents and other additives are well known to the person skilled in the art and will not be further discussed herein. The napkins may have any suitable shape and/or size and may be embossed, perforated, printed and dyed if desired. The napkins may be single-ply sheets of material or may include two or more plies of the same or different materials. In the stack, the napkins are folded at least once in order to obtain an interfolded arrangement with interconnected panels. However, the napkins may be additionally folded in order to reduce their planar size to a practical dimension as is well known in the art. Accordingly, any type of interfolding of the napkins may be used, as known in the art.

The physical form of the container may be a substantially rigid box.

The container material may be any material suitable for the purpose such as plastic, wood, ceramic, etc. The container may be formed e.g. by bending a sheet of material, molding, blow-molding, extrusion, cutting, sawing, etc. The container may also be made by a combination of different materials. When the dispenser includes a cover separate from the container, the cover may be made by one or a combination of any of the above mentioned materials. The container and the cover may be made by the same, or by different materials. It is noteworthy that the dispenser is intended for multiple use. In other words, the dispenser is intended to be refilled, rather than disposed, when empty.

The dispenser arrangement according to embodiments of the invention has a simple construction and may be made from inexpensive and readily available materials. Moreover, the dispenser arrangement according to embodiments of the invention has a surprisingly reliable function and will not damage the dispensed napkins.

Further, the dispenser may be manufactured having a tidy and fancy appearance by choosing exclusive materials, such as brushed steel, aluminum or wood. This may be desirable when the dispenser is intended to be used in formal and elegant environments.

BRIEF DESCRIPTION OF THE DRAWINGS

Embodiments of the invention will now be described by way of example only and with reference to the accompanying drawings, of which.

DETAILED DESCRIPTION

Figure 1:
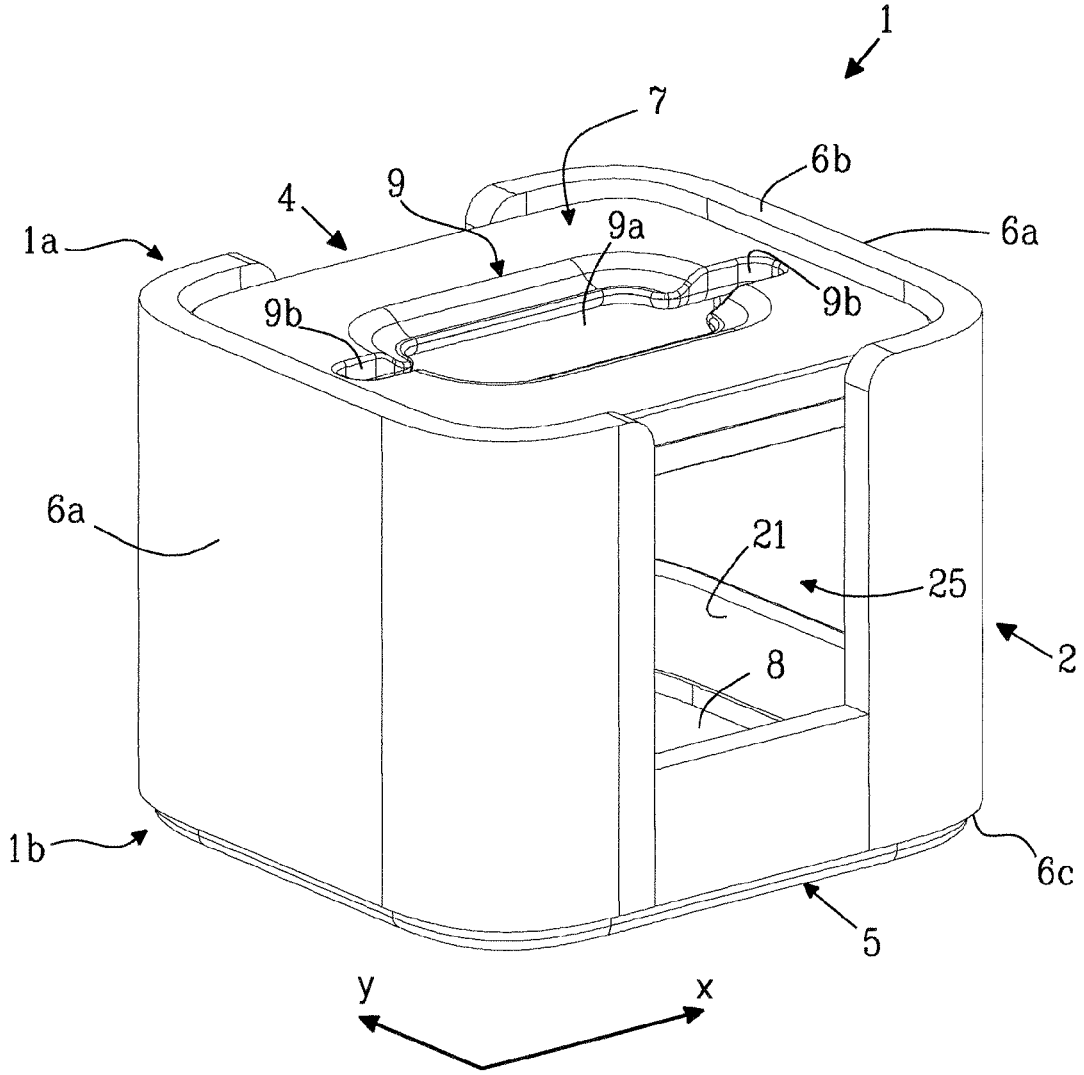
FIG. 1 shows a perspective view of a dispenser according to an embodiment of the present invention standing in upright position.

FIG. 1 illustrates a dispenser 1 for interfolded napkins. The dispenser 1 includes a container 2 having a bottom wall 5 extending in a horizontal plane of the dispenser 1. The container 2 further includes side walls 6 extending from the bottom wall 5 in a vertical direction perpendicular to the horizontal plane of the bottom wall 5 and defining a dispensing opening 7 arranged at the upper portion 1*a* of the dispenser 1 and being opposite to the bottom wall 5. The side walls 6 surround a supporting surface 8 for supporting a stack of interfolded napkins.

The dispenser 1 further includes a weight 4 arranged between the side walls 6 so as to form a stack-supported lid of the dispenser 1. The weight 4 defines a dispensing mouth 9 through which napkins are withdrawn. The weight 4 is movable between an upper position adjacent to the dispensing opening 7 of the container 2, and a lower position adjacent to the supporting surface 8 of the container 2.

Figure 1A:
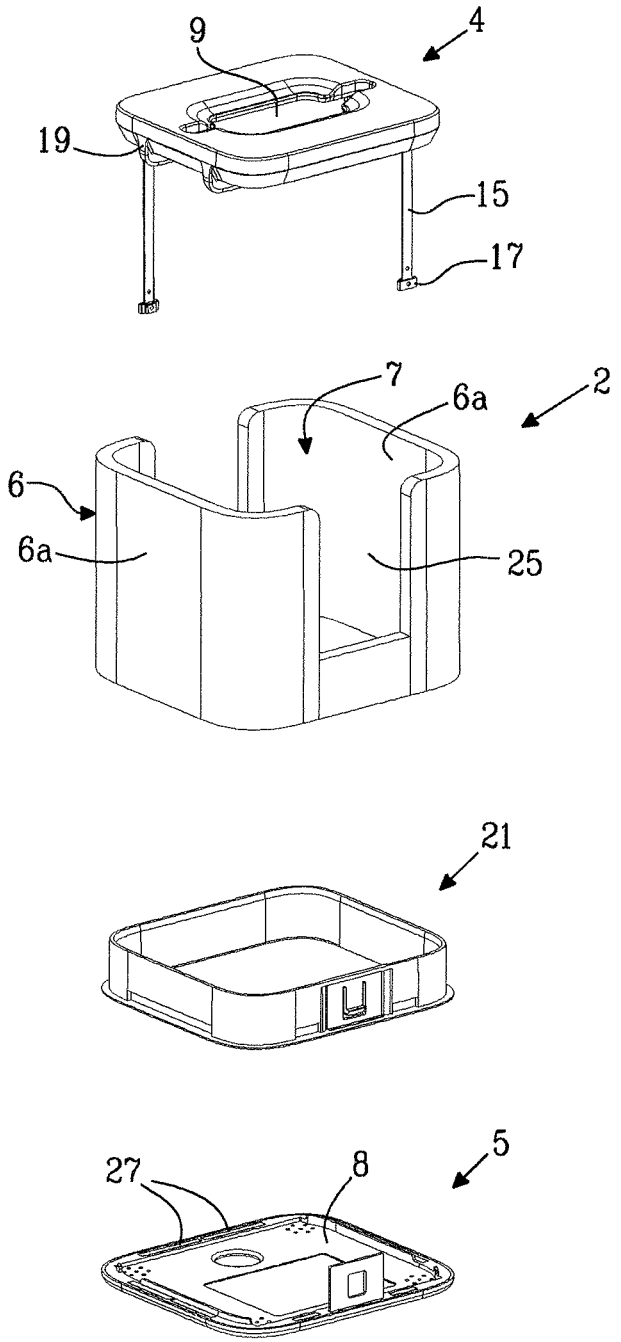
FIG. 1A depicts an exploded view of the dispenser illustrated in FIG. 1.

In the embodiment shown in FIGS. 1 and 1A, the bottom wall 5 of the container 2 forms the outermost bottom surface of the dispenser. This provides a simple and space-saving solution.

Figure 2:
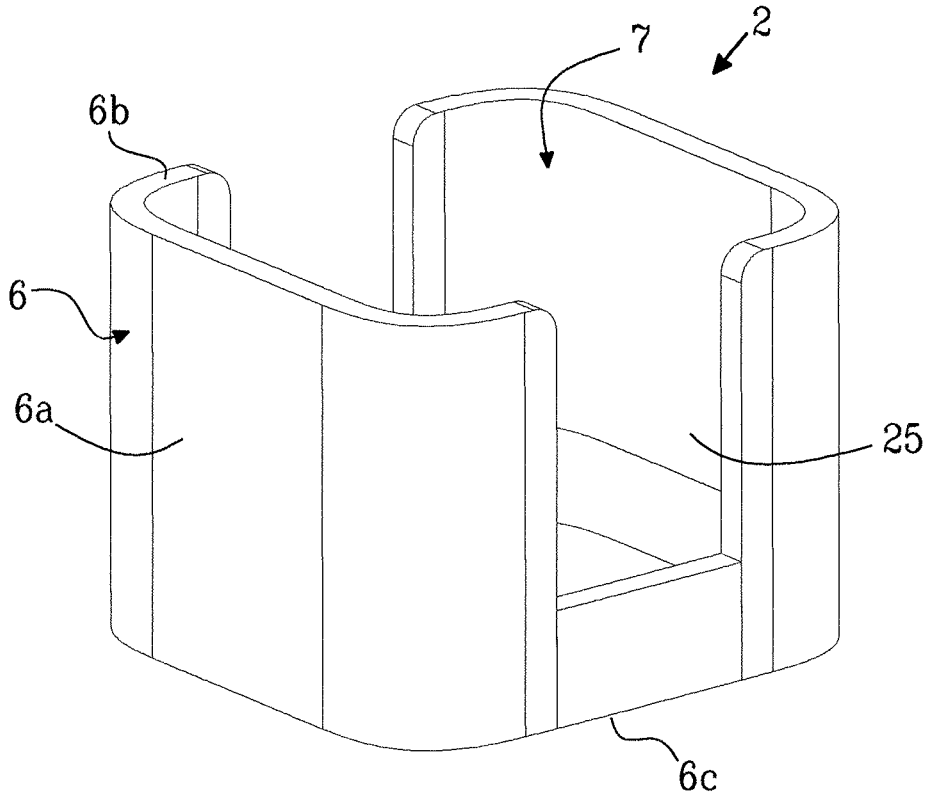
FIG. 2 shows a perspective view of the container of the dispenser of FIG. 1.

The container is shown in greater detail in FIG. 2. The side walls 6 of the container 2 are perpendicular to the plane of the bottom wall 5 of the container 2. The side walls 6 delimit the container space and the size of the dispensing opening 7 and are arranged to contain and support the stack of interfolded napkins without deforming the napkins.

The side walls 6 define the dispensing opening 7 arranged at an upper portion of the dispenser. The dispensing opening 7 is a part of the container being open towards the ambient and providing access to the inner space of the container 2. The outline of the dispensing opening 7 corresponds to the shape of the bottom wall 5, such that the container 2 depicted in FIG. 2 is symmetrical.

The upper edges 6*b* of the side walls 6 are entirely positioned in a horizontal plane being parallel to the plane of the bottom wall 5, whereby a stable upside-down position of the dispenser 1 is enabled, as will be discussed later.

Figure 3:
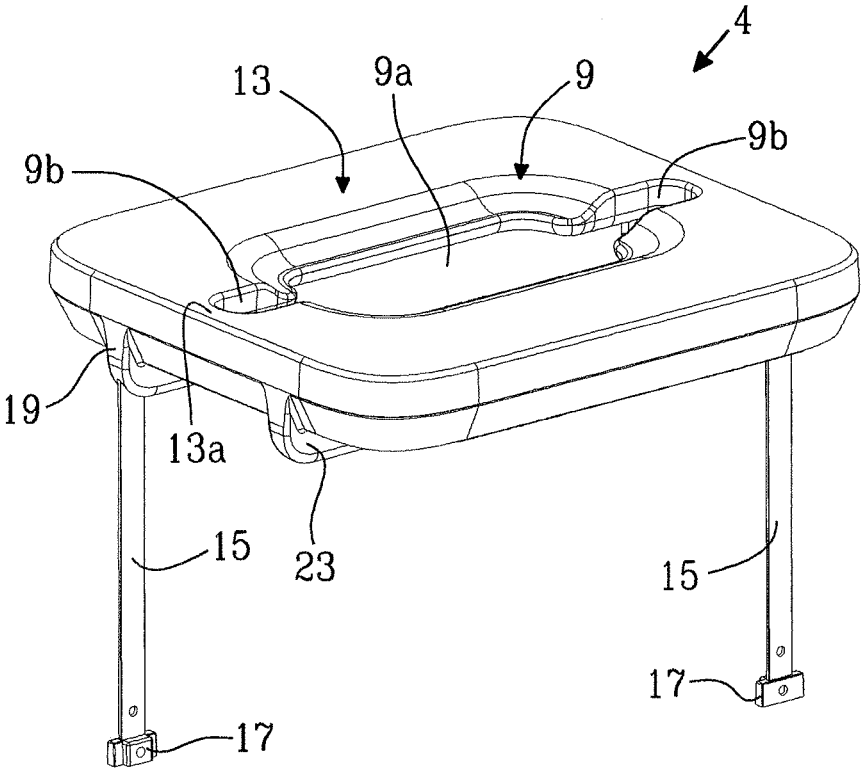
FIG. 3 illustrates a perspective view of the weight of the dispenser of FIG. 1 having two weight control means.

FIG. 3 illustrates the weight 4 in the dispenser illustrated in FIG. 1. The weight 4 defines an outer rim 13 including at least two opposing rim portions 13*a*. Further, as may be seen in FIG. 1, the weight 4 extends over the entire dispensing opening 7 in the horizontal plane between the side walls 6 of the container 2, such that the outer rim 13 is in contact with the side walls 6 of the container 2. As mentioned previously, "in contact", as used herein, means that there is a minimal space between the rim 13 and the side walls 6 sufficient to allow movement of the rim 13 along the side wall 6.

The weight depicted in FIG. 3 includes a dispensing mouth 9, i.e. an opening through which items are dispensed, running in the longitudinal direction x of the weight 4, coinciding with the longitudinal direction x of the dispenser 1.

Figure 4:
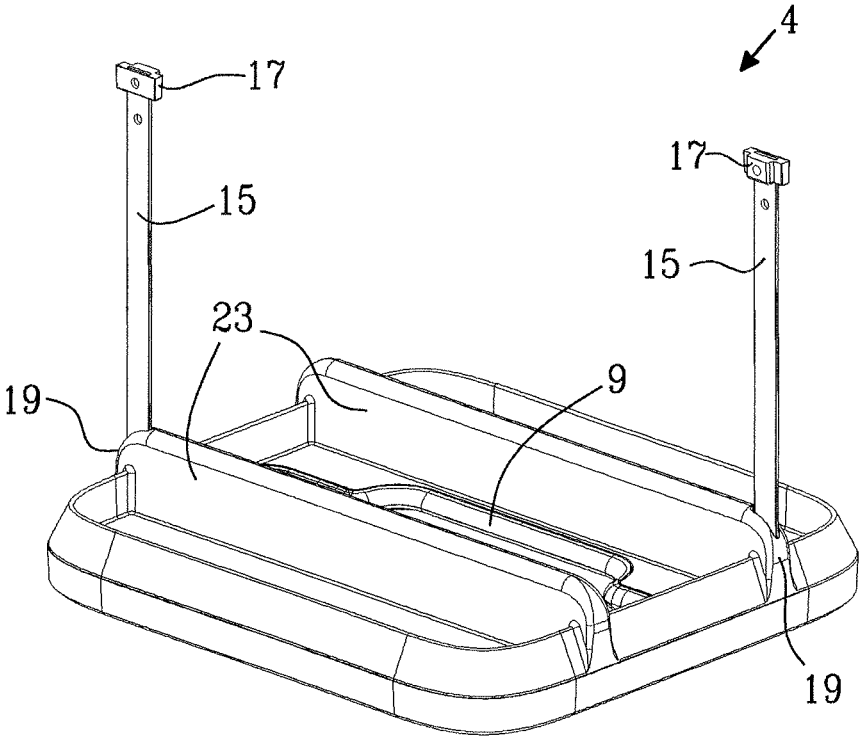
FIG. 4 depicts a bottom perspective view of the weight of the dispenser of FIG. 1.

The weight illustrated in FIG. 3 includes two protrusions 23 in the form of continuous longitudinally extending ribs arranged at a distance from the dispensing mouth 9, which is seen in greater detail in FIG. 4. Accordingly, the protrusions ensure that there is a space between the lower surface of the weight 4 immediately surrounding the dispensing mouth 9, and the top of the stack of napkins introduced in the dispenser. Such a space will ensure that the stack is not clamped against the dispensing mouth 9, which would complicate removal of napkins from the stack.

As depicted in FIG. 1, the weight 4 extends over the dispensing opening 7 substantially all the way between two opposing side walls 6*a* of the container 2, and the dispensing mouth 9 is arranged such that it extends in a longitudinal direction x of the dispenser 1 between the opposing rim portions 13*a* over substantially the entire longitudinal extension of the weight 4.

The dispensing mouth 9 also has a transverse extension, or a width, in a transverse direction of the weight 4 perpendicular to the length extension of the mouth. The width of the dispensing mouth should be sufficient for a napkin to easily pass there through. Moreover, the dispensing mouth 9 is provided with a portion 9*a* having a greater width than the other portions 9*b* of the dispensing mouth 9. The portion 9*a* with a greater width is designed so as to facilitate gripping of the napkin. Further, it is still desired to provide portions 9*b* positioned adjacent to the side walls 6*a* of the dispensing mouth 9 with a relatively narrow width. Such portions support a leading end protruding through the dispensing mouth 9, such that the leading end is presented in an upright position for a user to grasp.

The dispensing mouth 9 depicted in FIG. 3 is substantially rectangular with rounded corners, such that the outline of the dispensing mouth 9 corresponds to the outline of the weight 4, which is aesthetically appealing.

The dispenser 1 further includes two weight control means 15, seen in FIGS. 3 and 4. The weight control means 15 interconnect the weight 4 and the container 2 and is located inside the dispenser 1 when the dispenser 1 is assembled, and extend inside the container 2 between a container connection 17 arranged at the lower portion 1*b* of the dispenser 1 and a weight connection 19. The weight control means 15 restrict the movement of the weight 4 in a vertical direction along the side walls 6 so as to determine the location of the upper position of the weight 4, thus determining the maximum size of a stack to be introduced into the dispenser. Further, the weight control means 15 will ensure that the weight 4 cannot be completely removed from the container 2.

Moreover, the weight control means 15 will contribute to the control of the movement of the weight 4 inside the dispenser 1 between the upper position and the lower position.

As may be seen in FIG. 4, two weight control means 15 are arranged in a diagonally opposing manner in order to achieve an optimal distribution of the pull force from a user extracting an item from the dispenser.

The length of the weight control means 15 between the container connection 17 and the weight connection 19 essentially corresponds to the vertical distance from the container connection 17 to the dispensing opening 7, as seen in FIG. 1A. Accordingly, essentially the full vertical length of the container 2 from the supporting surface 8 to the dispensing opening 7 will be available for a stack of napkins. The weight connection 19 depicted in FIG. 4 is arranged at the rim 13 of the weight 4.

Figure 5:
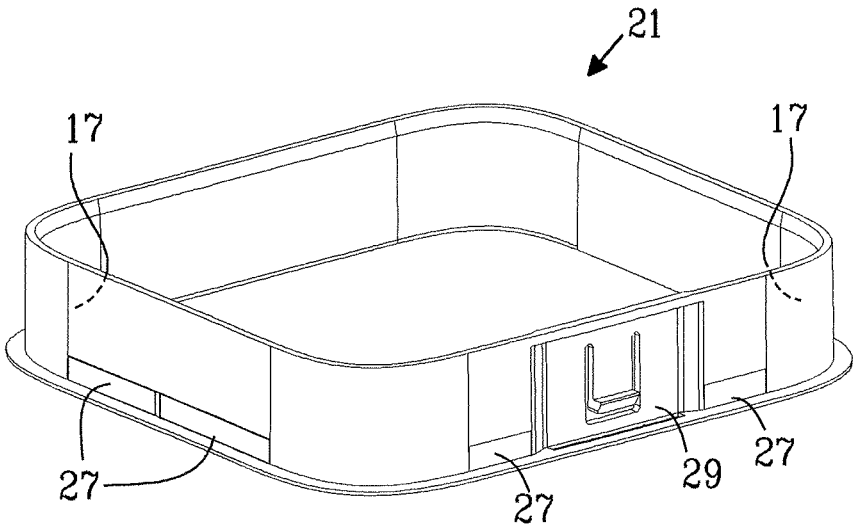
FIG. 5 shows a perspective view of a frame and a bottom wall of the dispenser of FIG. 1.
Figure 5:
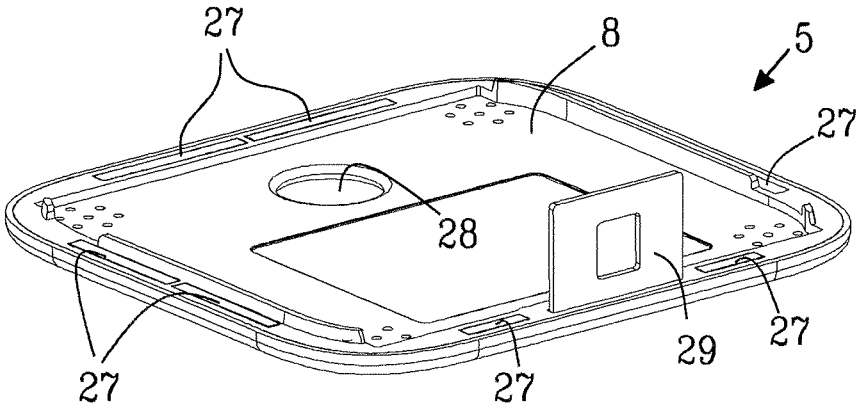

Further, the dispenser 1 includes a frame 21, depicted in FIG. 5 and arranged along the side walls 6 surrounding the supporting surface 8 as shown in FIG. 1. The frame 21 includes the mating part 17' of the container connection 17 and is positioned adjacent to the bottom wall 5 at the lower edge 6*b* of the side walls 6.

The container 2 depicted in FIG. 2 define one vertical slot 25 in each of the longitudinal side walls 6. The horizontal extension of the vertical slot 25 is sufficient to allow manual access to the napkins in the container 2 via the slot 25.

The dispenser defines a bottom portion, in the embodiment shown in FIG. 1A being constituted by the bottom wall 5, and a wall portion including a part of the side walls 6 including the lower edge 6*c* of the side walls 6, and the frame 21. The bottom portion is removably attached to the wall portion. Accordingly, the bottom portion may be removed from the wall portion for refill of napkins from the bottom end of the dispenser.

Hence, refill is possible even though the weight 4 remains in the dispensing opening 7 of the container, attached via the weight control means 15 to the side walls 6 of the container 2.

The frame 21 as described above is used to provide a connection between the bottom portion and the wall portion of the dispenser 1. The bottom portion is removably attached to the wall portion by means of a magnetic lock 27. The advantages of using a magnetic lock have been mentioned above.

The magnets and corresponding magnetic materials of the magnetic lock 27 are arranged in a generally opposing relationship. The interfacing surfaces formed between the magnets and corresponding magnetic materials are, in this embodiment, similar in size and shape.

The frame 21 depicted in FIG. 5 is used to provide magnets to the wall portion of the dispenser. Corresponding magnetic material pieces are provided in the bottom wall, as shown in FIG. 5.

Moreover, the frame 21 is used to provide a connector 29 between the wall portion and the bottom portion of the dispenser. In the illustrated embodiment, the connector 29 is in the form of a soft-hinge connector. The soft-hinge connector includes a soft material ribbon which is inserted into a corresponding slot in the frame, thereby providing the connector 29.

The bottom wall 5 is provided with a gripping means 28 in the form of a circular notch for facilitating removal of the bottom wall from the wall portion of the dispenser 1.

Figure 6:
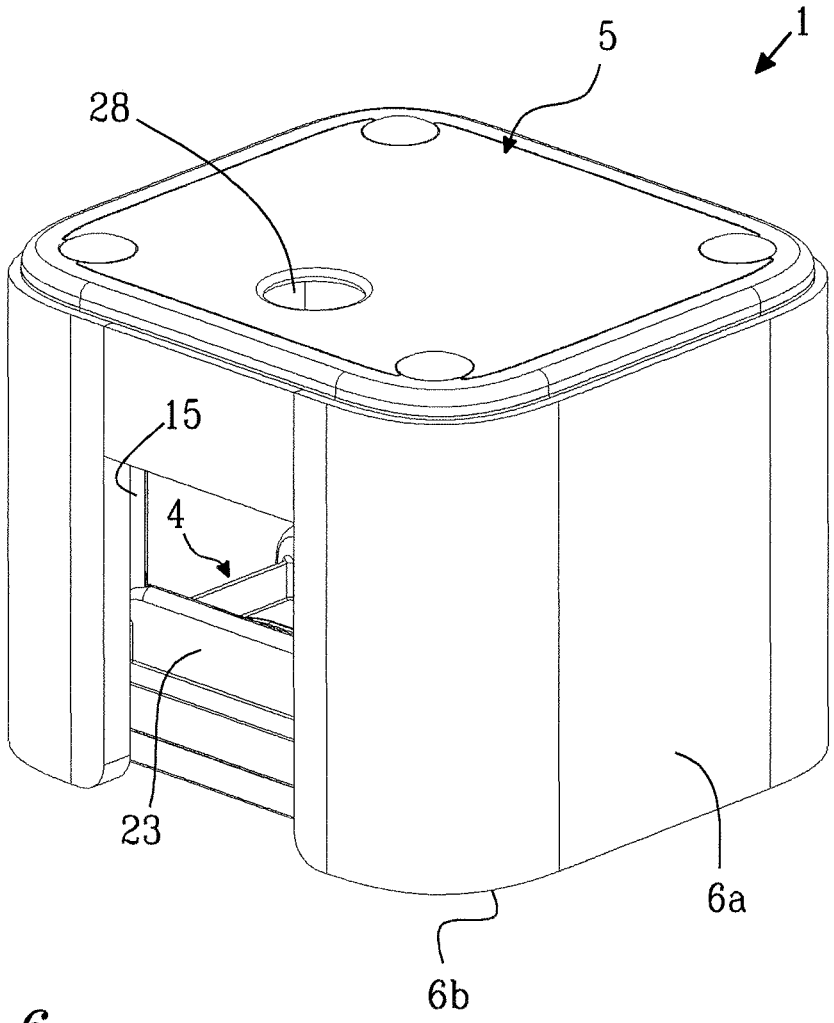
FIG. 6 illustrates a bottom perspective view of the dispenser depicted in FIG. 1.
Figure 7:
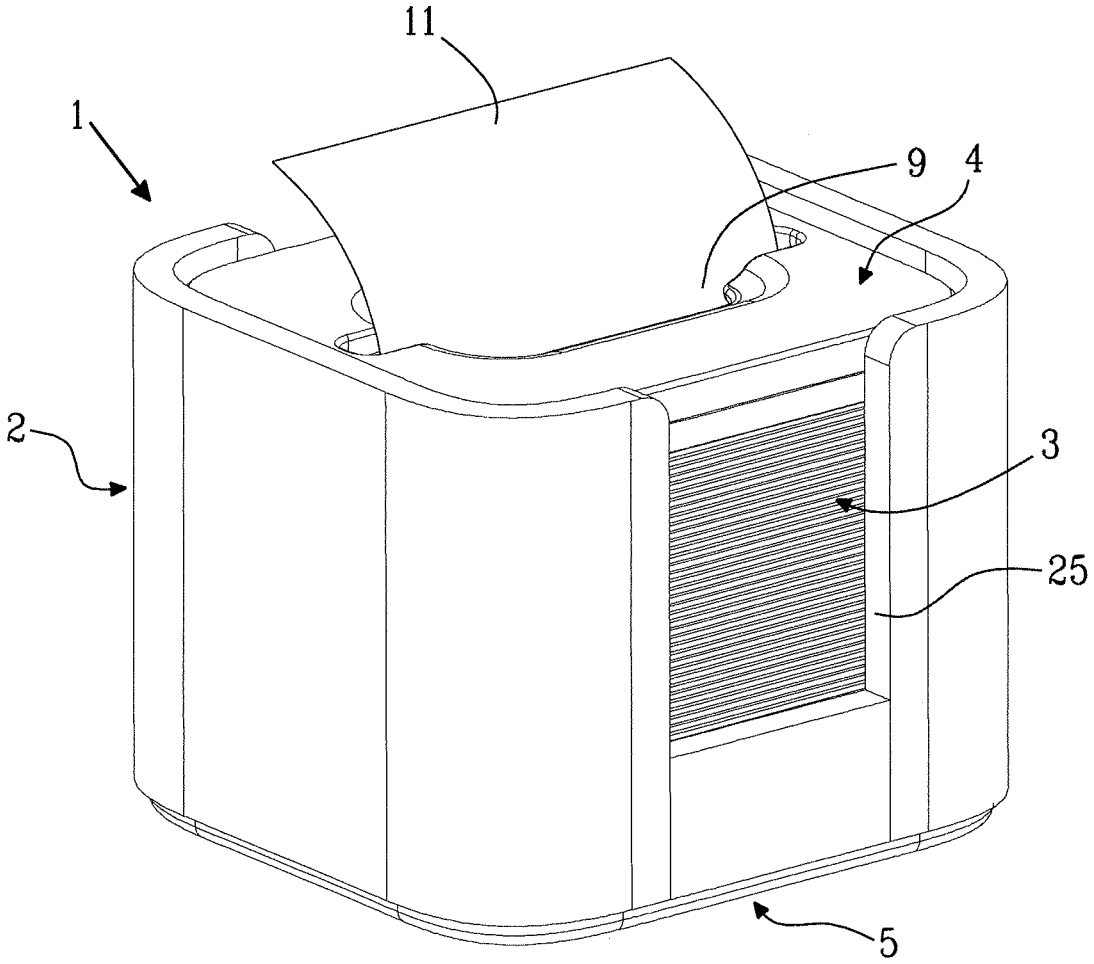
FIG. 7 illustrates a perspective view of the dispenser of FIG. 1 including napkins to be dispensed.
Figure 8:
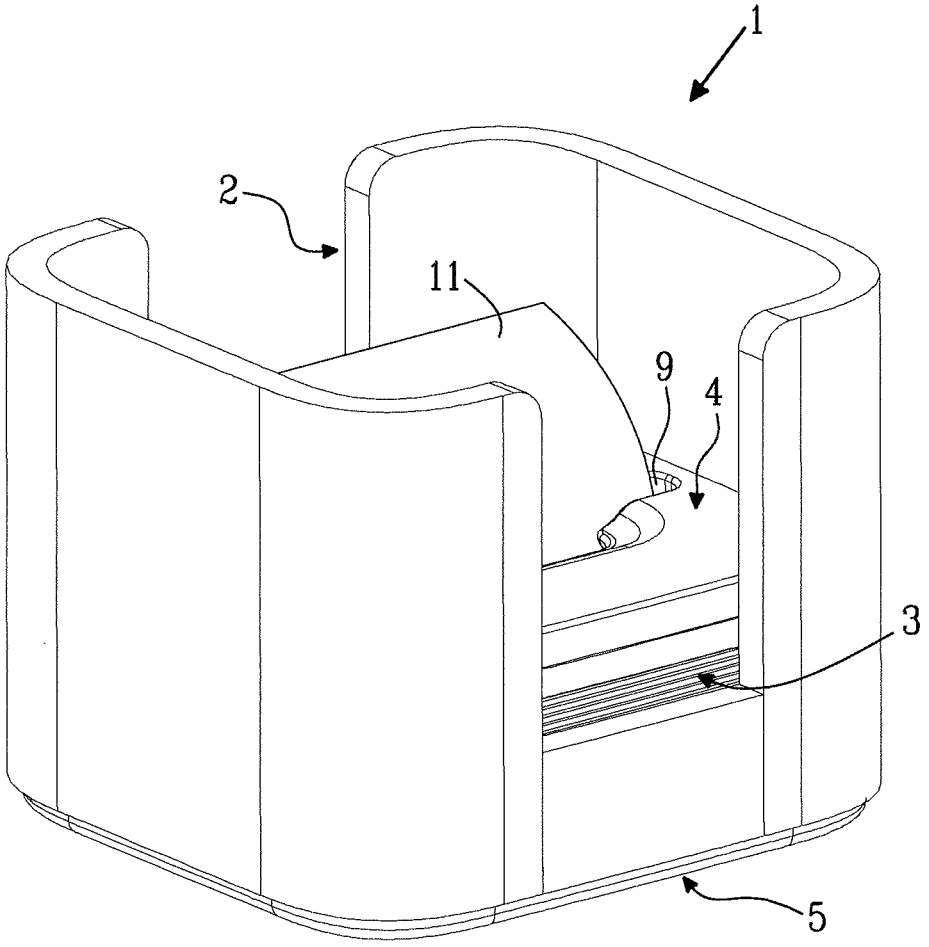
FIG. 8 illustrates a perspective view of the dispenser depicted in FIG. 1 including napkins to be dispensed in a nearly empty state.

As seen in FIGS. 1 and 1A, the upper edge 6*b* of the side walls 6 is confined in a horizontal plane, whereby a stable upside-down position of the dispenser 1 is enabled, as shown in FIG. 6. Accordingly, the dispenser 1 may conveniently be positioned resting on the upper edge 6*b* of the side walls 6 in an upside down position for refill of the dispenser 1 from the bottom side thereof.

When the dispenser 1 is assembled, the frame 21 is positioned inside the container 2 at the lower edge 6*c* of the side walls 6 of the container 2. The bottom wall 5 is attached at the lower edge 6*c* of the container 2 by means of the magnetic lock 27, such that the container 2 is open towards the ambient only at the dispensing opening 7 of the container. Finally, the weight 4 is attached to the dispenser 1 by means of the container connection 17. When the dispenser 1 is empty or nearly empty, the weight 4 will be in its lower position adjacent to the supporting surface 8 of the container 2.

When the dispenser 1 is to be filled or refilled with items to be dispensed, the dispenser 1 is brought in the upside down position such that the dispenser 1 rests on the upper edges 6*b* of the side walls 6 of the container 2. When the dispenser 1 is being turned around, it may be advisable to provide a support for the weight 4, such that the weight 4 and the remaining items, if any, inside the container does not uncontrollably fall down under action of gravity, which may cause unduly high and possibly damaging stress on the weight control means, as well as wrinkling, creasing or other rearrangement of the remaining items inside the container, which may damage the items and worsen the dispensing.

To this end, the user may utilise the vertical slot 25 provided in the side walls 6 of the dispenser, so as to hold the weight and any remaining napkins towards the support surface during turning of the dispenser.

When the dispenser 1 is in its upside down position, the bottom wall 5 is disconnected from the side walls 6 by gripping the gripping means 28 and opening the lock 27. After the bottom wall 5 has been disconnected, a stack of interfolded napkins is inserted into the dispenser 1, and the bottom wall 5 is reattached to the dispenser 1. Finally, the dispenser 1 is turned around once more, bringing it to the upright position, and the leading end of the uppermost napkin is extracted through the dispensing mouth such that the dispenser 1 becomes ready for use.

When the dispenser 1 is completely filled, the weight 4 forms a stack-supported lid of the dispenser 1, meaning that when a stack of napkins is inserted in the dispenser 1, the weight 4 will rest on the stack. Accordingly, when the dispenser 1 is completely filled with napkins, the weight 4 will be in its upper position located adjacent to the dispensing opening 7 of the container.

The weight 4 including the dispensing mouth 9 will simultaneously present a leading end of the uppermost napkin in the stack through the dispensing mouth 9, and hold down the remaining part of the stack, such that additional, unwanted napkins are not removed from the stack together with the uppermost napkin. Instead, due to the interfolding of the napkins, removal of the uppermost napkin will result in the leading end of the next napkin being presented in the dispensing mouth, as mentioned earlier.

By means of the weight 4 forming a dispensing mouth 9, fall-back of the leading end of the uppermost napkin in a stack of interfolded napkins is avoided without the risk of the tearing or wrinkling of the napkin being pulled out or of the subsequent napkin.

In use, the leading end of the uppermost napkin in the stack positioned in the dispenser 1 is extending between two opposing side walls 6*a*. Accordingly, the dispensing mouth 9 extends longitudinally along the width of the leading end of the napkin, such that the napkins may be extracted through the dispensing mouth 9 with minimal or no wrinkling, providing a tidy and appealing napkin both prior to and after dispensing.

As the napkins are being dispensed, the vertical extension of the stack inside the dispenser will decrease. Since the weight is supported by the stack of napkins, the weight will descend towards the supporting surface of the container with the decreasing vertical height of the stack. Hence, when the dispenser is nearly empty or empty, the weight will be located adjacent to the supporting surface of the container. The weight is vertically movable inside the container between an upper position adjacent to the dispensing opening of the container, and a lower position adjacent to the supporting surface of the container, in both the upward and the downward directions, due to the flexible character of the weight supporting means.

Although the present invention has been described with reference to various embodiments, those skilled in the art will recognise that changes may be made without departing from the scope of the invention. It is intended that the detailed description be regarded as illustrative and that the appended claims including all the equivalents are intended to define the scope of the invention.

The invention claimed is:

1. A dispenser for interfolded napkins, comprising:

a container having:

a bottom portion comprising a bottom wall extending in a horizontal plane, and side walls extending from the bottom wall in a vertical direction perpendicular thereto, a wall portion comprising at least a part of the side walls, and a dispensing opening opposite to the bottom wall, the side walls surrounding a rectangular supporting surface formed by said bottom wall, for supporting a stack of interfolded napkins, wherein said bottom portion is removably attached to the wall portion for refill of napkins from the bottom of the dispenser;

a weight arranged between said side walls so as to form a stack-supported lid of the dispenser, the weight defining a dispensing mouth and being movable between an upper position adjacent to the dispensing opening of the container, and a lower position adjacent to the supporting surface of the container; and a weight control means interconnecting the weight and the container, and extending inside the container between a container connection and a weight connection, said weight control means restricting the movement of the weight in a vertical direction along said side walls so as to determine a location of said upper position of said weight.

2. The dispenser according to claim 1, wherein the weight comprises an outer rim comprising at least two opposing rim portions.

3. The dispenser according to claim 2, wherein the weight extends over the entire dispensing opening in at least one horizontal direction between at least two opposing side walls of the container, such that said two opposing rim portions are in contact with corresponding portions of two opposing side walls of the container.

4. The dispenser according to claim 3, wherein the container connection is situated at one of said opposing side walls and adjacent to the supporting surface of the container, and the weight connection is situated adjacent to the corresponding one of said opposing rim portions.

5. The dispenser according to claim 3, wherein the dispenser comprises two weight control means interconnecting the weight and the container, the weight control means being arranged one at each opposing side wall and corresponding rim portion.

6. The dispenser according to claim 1, wherein the weight control means comprises a flexible cord.

7. The dispenser according to claim 1, wherein the container connection is located adjacent the support surface.

8. The dispenser according to claim 1, wherein the container connection comprises a snap-in connection.

9. The dispenser according to claim 1, wherein the container further comprises a frame arranged along the side walls surrounding the supporting surface, said frame comprising the container connection.

10. The dispenser according to claim 1, wherein a length of the weight control means between the container connection and the weight connection essentially corresponds to a vertical distance from the container connection to the dispensing opening.

11. The dispenser according to claim 1, wherein the container connection is arranged adjacent the supporting surface, and a length of the weight control means approximately corresponds to a vertical distance from the supporting surface to the dispensing opening.

12. The dispenser according to claim 1, wherein the weight is confined between said side walls.

13. The dispenser according to claim 1, wherein an outline of the dispensing opening essentially corresponds to an outline of the supporting surface.

14. The dispenser according to claim 1, wherein the side walls comprise at least two opposing side walls, and wherein the dispensing mouth is elongate and has a maximum length dimension extending in parallel with two opposing side walls.

15. The dispenser according to claim 1, wherein the side walls comprise at least two opposing side walls, and wherein the dispensing mouth has a maximum length of at least 75% of the length of the supporting surface extending between said two opposing side walls.

16. The dispenser according to claim 1, wherein the total horizontal area of the weight including the dispensing mouth is at least 60% of the area of the supporting surface.

17. The dispenser according to claim 1, wherein the weight has a vertical extension being 1-10 cm.

18. The dispenser according to claim 1, wherein the weight has a substantially flat lower surface facing towards the stack of napkins, the lower surface comprising spacing protrusions.

19. The dispenser according to claim 18, wherein said protrusions are arranged at a distance from the dispensing mouth.

20. The dispenser according to claim 1, wherein the weight comprises a first material and a second material, the second material having a greater density than the first material, so as to provide additional mass to the weight.

21. The dispenser according to claim 1, wherein the weight has a mass of between 50 and 1000g.

22. The dispenser according to claim 1, wherein the container comprises at least one vertical slot in at least one of said side walls, a horizontal extension of the slot being sufficient to allow manual access to the napkins in the container via said slot.

23. The dispenser according to claim 1, wherein the bottom portion consists of said bottom wall.

24. The dispenser according to claim 1, wherein the bottom portion is removably attached to the wall portion by a magnetic lock.

25. The dispenser according to claim 1, wherein the side walls comprise upper edges at the dispensing opening of the container, said upper edges form a plurality of uppermost edge portions, which are confined in a generally horizontal plane.

* * * * *